US011823599B2

(12) United States Patent
Dou et al.

(10) Patent No.: US 11,823,599 B2
(45) Date of Patent: Nov. 21, 2023

(54) THRESHOLD VOLTAGE DETECTING METHOD

(71) Applicant: SHENZHEN CHINA STAR OPTOELECTRONICS SEMICONDUCTOR DISPLAY TECHNOLOGY CO., LTD., Guangdong (CN)

(72) Inventors: Wei Dou, Guangdong (CN); Jing Xu, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 77 days.

(21) Appl. No.: 17/614,505

(22) PCT Filed: Oct. 28, 2021

(86) PCT No.: PCT/CN2021/126871
§ 371 (c)(1),
(2) Date: Nov. 26, 2021

(87) PCT Pub. No.: WO2023/060653
PCT Pub. Date: Apr. 20, 2023

(65) Prior Publication Data

US 2023/0120112 A1 Apr. 20, 2023

(30) Foreign Application Priority Data

Oct. 14, 2021 (CN) ..... 202111198336.X

(51) Int. Cl.
*G09G 3/00* (2006.01)
*G09G 3/3233* (2016.01)

(52) U.S. Cl.
CPC ..... *G09G 3/006* (2013.01); *G09G 3/3233* (2013.01); *G09G 2300/0842* (2013.01)

(58) Field of Classification Search
None
See application file for complete search history.

(56) References Cited

U.S. PATENT DOCUMENTS

2015/0123953 A1 5/2015 Shim et al.
2015/0325174 A1 11/2015 Yu et al.
(Continued)

FOREIGN PATENT DOCUMENTS

CN 105788530 A 7/2016
CN 106097943 A 11/2016
(Continued)

OTHER PUBLICATIONS

Chinese Office Action issued in corresponding Chinese Patent Application No. 202111198336.X dated Nov. 18, 2022, pp. 1-9.
(Continued)

*Primary Examiner* — Stephen T. Reed
(74) *Attorney, Agent, or Firm* — PV IP PC; Wei Te Chung; Zhigang Ma

(57) ABSTRACT

A threshold voltage detecting method is disclosed in the present application. In the threshold voltage detecting method provided in the present application, a path between a driving transistor and a detecting circuit is shut down during detecting, so that a current flowing through the driving transistor in a detecting stage only needs to charge a storage capacitor, but does not need to charge a parasitic capacitor on the detecting circuit, thereby shortening a threshold voltage detecting time of the driving transistor, and further improving threshold voltage detecting efficiency of the driving transistor.

18 Claims, 2 Drawing Sheets

(56) References Cited

U.S. PATENT DOCUMENTS

| | | | | |
|---|---|---|---|---|
| 2018/0204516 | A1* | 7/2018 | Hwang | G09G 3/3233 |
| 2019/0304362 | A1 | 10/2019 | Yuan et al. | |
| 2019/0385525 | A1* | 12/2019 | Jin | G09G 3/3208 |

FOREIGN PATENT DOCUMENTS

| | | | |
|---|---|---|---|
| CN | 106782320 | A | 5/2017 |
| CN | 108510922 | A | 9/2018 |
| CN | 112562557 | A | 3/2021 |
| WO | 2021068254 | A1 | 4/2021 |

OTHER PUBLICATIONS

Electronic Components and Materials Issue 9 Sep. 21, 2018 A-IGZO thin-film transistors integrated AMOLED pixel circuit Wang, Lanlan etc.

Chinese Journal of Luminescence Issue 5 May 15, 2016 Investigation of V TH Detection Methods for AMOLED Pixel Circuit Design with IGZO-TFT Wang, Aoyun etc.

International Search Report in International application No. PCT/CN2021/126871,dated May 25, 2022.

Written Opinion of the International Search Authority in International application No. PCT/CN2021/126871,dated May 25, 2022.

* cited by examiner

THRESHOLD VOLTAGE DETECTING METHOD

BACKGROUND OF DISCLOSURE

Field of Disclosure

The present disclosure relates to a field of display technology, in particular to a threshold voltage detecting method.

Description of Prior Art

Organic light-emitting diode display devices are divided into two main categories of a passive-matrix type and an active-matrix type according to a driving mode, i.e., a direct addressing and a thin film transistor matrix addressing. In the driving mode of the active-matrix type, a pixel driving circuit is provided with a driving transistor for driving an organic light-emitting diode to emit light. Since the driving transistor operates in a saturation region, a current flowing through the driving transistor is influenced by a threshold voltage and mobility of the driving transistor itself. Therefore, in order to ensure evenness of display luminance of the organic light-emitting diode display device, it is necessary to compensate for differences in a threshold voltage and mobility between different sub-pixels.

In a conventional threshold voltage detecting method, an initial gate-source voltage ($V_{gs}$) is given to the driving transistor, and then a gate voltage of the driving transistor remains unchanged using a source following method, so that a source voltage of the driving transistor rises to a state of $V_{gs}=V_{th}$, wherein $V_{th}$ is the threshold voltage of the driving transistor, and the current flowing through the driving transistor approaches zero. In this state, the source voltage of the driving transistor is sampled, the threshold voltage of the driving transistor is calculated, and then the obtained threshold voltage is superimposed on a data voltage for display, thereby realizing compensation for the differences in the threshold voltage and eliminating display luminance unevenness caused by the differences in the threshold voltage.

However, as the $V_{gs}$ in detecting decreases and a parasitic capacitor of a detecting line is much greater than a storage capacitor of a single sub-pixel, a rise of the source voltage of the driving transistor becomes slower and slower, and it takes a long time for the differences in the threshold voltage of the driving transistor of different sub-pixels to be completely detected. This greatly affects production capacity and investment in detecting equipment. In addition, a detection of the threshold voltage can only be performed in a black screen, so that a standby time before powering on or after powering off is occupied, and user experience is greatly affected.

SUMMARY OF DISCLOSURE

The present disclosure provides a threshold voltage detecting method, which can shorten a threshold voltage detecting time of a driving transistor, further improve threshold voltage detecting efficiency of the driving transistor and improve user experience.

In a first aspect, the present disclosure provides a threshold voltage detecting method, wherein the threshold voltage detecting method comprises:

A step S1: providing a display device driving system, wherein the display device driving system comprises a pixel driving circuit and a detecting circuit electrically connected to the pixel driving circuit;

the pixel driving circuit comprises a driving transistor, a first transistor, a second transistor, a storage capacitor, and a light-emitting device; a gate of the driving transistor, one of a source and a drain of the first transistor, and a first end of the storage capacitor are electrically connected to a first node; one of a source and a drain of the driving transistor is electrically connected to a first voltage source; another one of the source and the drain of the driving transistor, one of a source and a drain of the second transistor, a second end of the storage capacitor, and an anode of the light-emitting device are electrically connected to a second node; another one of the source and the drain of the first transistor is connected to a data signal, and a gate of the first transistor is connected to a control signal; another one of the source and the drain of the second transistor is electrically connected to the detecting circuit, and a gate of the second transistor is connected to a detecting signal; and a cathode of the light-emitting device is electrically connected to a second voltage source;

A step S2: the control signal supplying a turned-on potential, the detecting signal supplying the turned-on potential, wherein the first transistor is turned on, the second transistor is turned on, the data signal supplies a data potential to the first node, and the detecting circuit supplies an initialization potential to the second node;

A step S3: the control signal supplying the turned-on potential, the detecting signal supplying a turned-off potential, wherein the first transistor is turned on, the second transistor is turned off, the data signal continues to supply the data potential to the first node, a potential of the second node rises by a driving current until a difference between a potential of the first node and the potential of the second node is equal to a threshold voltage of the driving transistor;

A step S4: the control signal supplying the turned-off potential, the detecting signal supplying the turned-on potential, wherein the first transistor is turned off, the second transistor is turned on, the storage capacitor is voltage coupled to a parasitic capacitor on the detecting circuit 102, the detecting circuit detects the potential of the second node and calculates the threshold voltage of the driving transistor based on the potential of the second node;

wherein in the step S2, a difference between the data potential and the initialization potential is greater than the threshold voltage of the driving transistor;

in the step S3, the driving current $I=(\mu*w*Cox)/2L*(V_g-V_s-V_{th})\hat{}2$, wherein $\mu$ is mobility of the driving transistor, W/L is a width-to-length ratio of a conductive channel of the driving transistor, Cox is a gate oxide layer capacitance per unit area of the driving transistor, $V_g$ is the potential of the first node, $V_s$ is the potential of the second node, and $V_{th}$ is the threshold voltage of the driving transistor.

In the threshold voltage detecting method provided in the present disclosure, in the step S3, the potential of the second node is $V_s=V_0+I/C_1$, wherein $V_0$ is the initialization potential, and $C_1$ is a capacitance value of the storage capacitor.

In the threshold voltage detecting method provided in the present disclosure, in the step S3, the potential of the first node remains unchanged, and the potential of the second node increases as the driving current charges the storage capacitor.

In the threshold voltage detecting method provided in the present disclosure, the driving current decreases while the potential of the second node increases until the potential of the second node becomes stable when the driving current is 0.

In the threshold voltage detecting method provided in the present disclosure, the step S4 of the detecting circuit detecting the potential of the second node and calculating the threshold voltage of the driving transistor based on the potential of the second node comprises:

obtaining the potential of the second node after voltage coupling;

obtaining the potential of the second node before the voltage coupling based on the potential of the second node after the voltage coupling and a preset voltage coupling formula; and obtaining the threshold voltage of the driving transistor according to the potential of the second node before the voltage coupling, the data potential, and a threshold voltage calculation formula.

In the threshold voltage detecting method provided in the present disclosure, the preset voltage coupling formula is $V_{s1}=(V_{s2}-V_0)*(C_1+C_2)/C_2+V_0$, wherein $V_{s1}$ is the potential of the second node before the voltage coupling, $V_{s2}$ is the potential of the second node after the voltage coupling, $V_0$ is the initialization potential, $C_1$ is a capacitance value of the storage capacitor, and $C_2$ is a capacitance value of the parasitic capacitor.

In the threshold voltage detecting method provided in the present disclosure, the threshold voltage calculation formula is $V_{th}=V_g-V_{s1}$, wherein $V_{th}$ is the threshold voltage of the driving transistor, $V_g$ is the potential of the first node, and $V_{s1}$ is the potential of the second node before the voltage coupling.

In the threshold voltage detecting method provided in the present disclosure, a time for the potential of the second node to rise by the driving current until the difference between the potential of the first node and the potential of the second node is equal to the threshold voltage of the driving transistor is less than 30 milliseconds.

In a second aspect, the present disclosure provides a threshold voltage detecting method, wherein the threshold voltage detecting method comprises:

A step S1: providing a display device driving system, wherein the display device driving system comprises a pixel driving circuit and a detecting circuit electrically connected to the pixel driving circuit;

the pixel driving circuit comprises a driving transistor, a first transistor, a second transistor, a storage capacitor, and a light-emitting device; a gate of the driving transistor, one of a source and a drain of the first transistor, and a first end of the storage capacitor are electrically connected to a first node; one of a source and a drain of the driving transistor is electrically connected to a first voltage source; another one of the source and the drain of the driving transistor, one of a source and a drain of the second transistor, a second end of the storage capacitor, and an anode of the light-emitting device are electrically connected to a second node; another one of the source and the drain of the first transistor is connected to a data signal, and a gate of the first transistor is connected to a control signal; another one of the source and the drain of the second transistor is electrically connected to the detecting circuit, and a gate of the second transistor is connected to a detecting signal; and a cathode of the light-emitting device is electrically connected to a second voltage source;

A step S2: the control signal supplying a turned-on potential, the detecting signal supplying the turned-on potential, wherein the first transistor is turned on, the second transistor is turned on, the data signal supplies a data potential to the first node, and the detecting circuit supplies an initialization potential to the second node;

A step S3: the control signal supplying the turned-on potential, the detecting signal supplying a turned-off potential, wherein the first transistor is turned on, the second transistor is turned off, the data signal continues to supply the data potential to the first node, a potential of the second node rises by a driving current until a difference between a potential of the first node and the potential of the second node is equal to a threshold voltage of the driving transistor;

A step S4: the control signal supplying the turned-off potential, the detecting signal supplying the turned-on potential, wherein the first transistor is turned off, the second transistor is turned on, the storage capacitor is voltage coupled to a parasitic capacitor on the detecting circuit 102, the detecting circuit detects the potential of the second node and calculates the threshold voltage of the driving transistor based on the potential of the second node.

In the threshold voltage detecting method provided in the present disclosure, in the step S2, a difference between the data potential and the initialization potential is greater than the threshold voltage of the driving transistor.

In the threshold voltage detecting method provided in the present disclosure, in the step S3, the driving current $I=(\mu*w*Cox)/2L*(V_g-V_s-V_{th})\hat{}2$, wherein μ is mobility of the driving transistor, W/L is a width-to-length ratio of a conductive channel of the driving transistor, Cox is a gate oxide layer capacitance per unit area of the driving transistor, $V_g$ is the potential of the first node, $V_s$ is the potential of the second node, and $V_{th}$ is the threshold voltage of the driving transistor.

In the threshold voltage detecting method provided in the present disclosure, in the step S3, the potential of the second node is $V_s=V_0+I/C_1$, wherein $V_0$ is the initialization potential, and $C_1$ is a capacitance value of the storage capacitor.

In the threshold voltage detecting method provided in the present disclosure, in the step S3, the potential of the first node remains unchanged, and the potential of the second node increases as the driving current charges the storage capacitor.

In the threshold voltage detecting method provided in the present disclosure, the driving current decreases while the potential of the second node increases until the potential of the second node becomes stable when the driving current is 0.

In the threshold voltage detecting method provided in the present disclosure, the step S4 of the detecting circuit detecting the potential of the second node and calculating the threshold voltage of the driving transistor based on the potential of the second node comprises:

obtaining the potential of the second node after voltage coupling;

obtaining the potential of the second node before the voltage coupling based on the potential of the second node after the voltage coupling and a preset voltage coupling formula; and obtaining the threshold voltage of the driving transistor according to the potential of the second node before the voltage coupling, the data potential, and a threshold voltage calculation formula.

In the threshold voltage detecting method provided in the present disclosure, the preset voltage coupling formula is $V_{s1}=(V_{s2}-V_0)*(C_1+C_2)/C_2+V_0$, wherein $V_{s1}$ is the potential of the second node before the voltage coupling, $V_{s2}$ is the potential of the second node after the voltage coupling, $V_0$ is the initialization potential, $C_1$ is a capacitance value of the storage capacitor, and $C_2$ is a capacitance value of the parasitic capacitor.

In the threshold voltage detecting method provided in the present disclosure, the threshold voltage calculation formula is $V_{th}=V_g-V_{s1}$, wherein $V_{th}$ is the threshold voltage of the driving transistor, $V_g$ is the potential of the first node, and $V_{s1}$ is the potential of the second node before the voltage coupling.

In the threshold voltage detecting method provided in the present disclosure, a time for the potential of the second node to rise by the driving current until the difference between the potential of the first node and the potential of the second node is equal to the threshold voltage of the driving transistor is less than 30 milliseconds.

In the threshold voltage detecting method provided in the present application, a path between the driving transistor and the detecting circuit is shut down during detecting, so that the current flowing through the driving transistor in a detecting stage only needs to charge the storage capacitor, but does not need to charge the parasitic capacitor on the detecting circuit, thereby shortening a threshold voltage detecting time of the driving transistor, and further improving threshold voltage detecting efficiency of the driving transistor.

DETAILED DESCRIPTION OF EMBODIMENTS

Technical solutions in embodiments of the present disclosure will be clearly and completely described below in conjunction with drawings in the embodiments of the present disclosure. Obviously, the described embodiments are only a part of embodiments of the present disclosure, rather than all the embodiments. Based on the embodiments in the present disclosure, all other embodiments obtained by those skilled in the art without creative work fall within protection scope of the present disclosure.

In addition, terms "first", "second" in this specification and claims of the present disclosure are used to distinguish different objects, rather than describe a specific order. Terms "include" and "have" and any variations thereof are intended to cover non-exclusive inclusion. Since a source and a drain of a transistor used in the present disclosure are symmetrical, the source and the drain can be interchanged.

Figure 1:
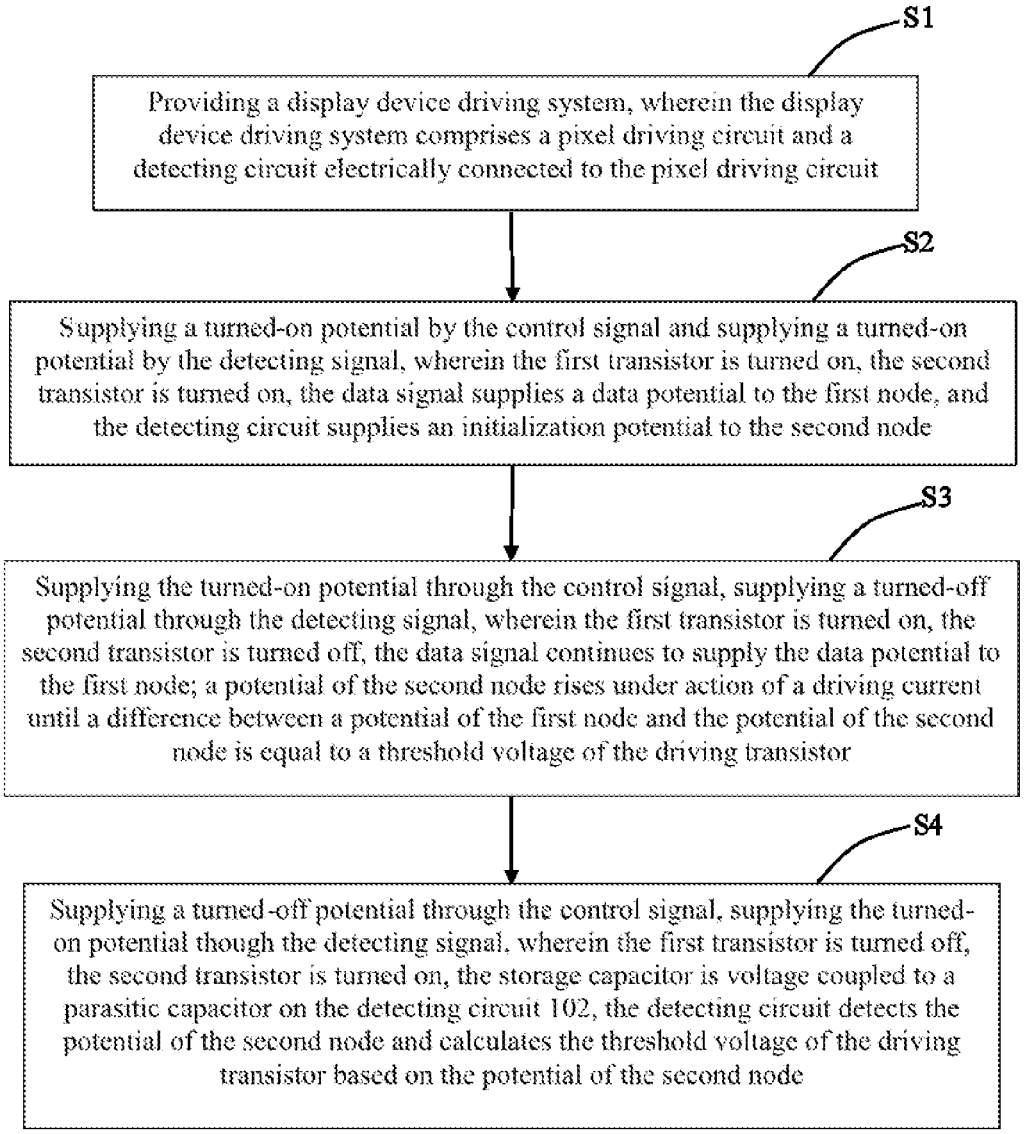
FIG. 1 is a flowchart of a threshold voltage detecting method according to an embodiment of the present disclosure.
Figure 2:
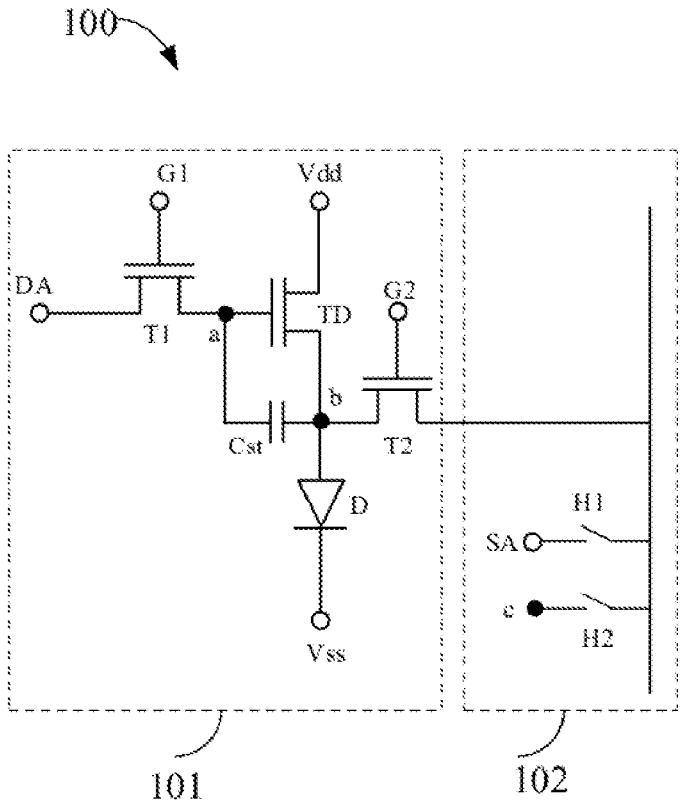
FIG. 2 is a schematic circuit diagram of a display device driving system according to an embodiment of the present disclosure.
Figure 3:
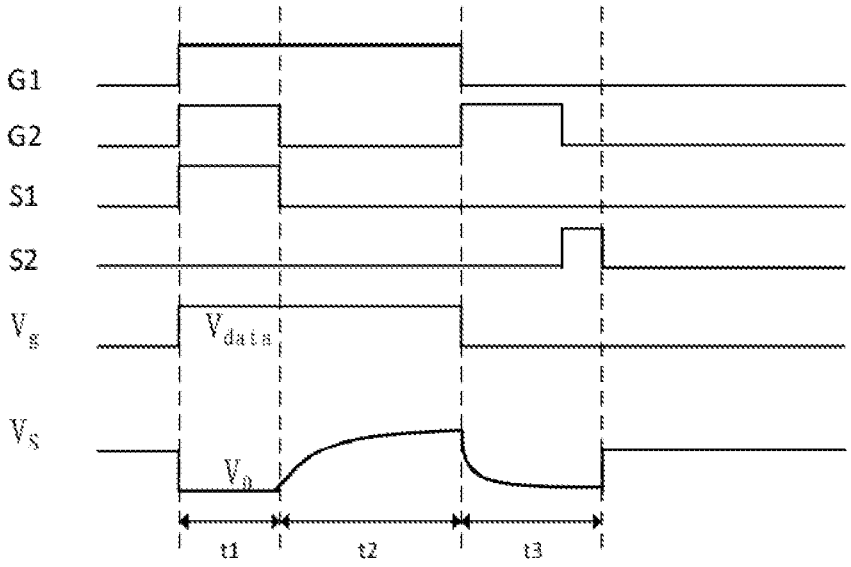
FIG. 3 is a timing diagram of a display device driving system according to an embodiment of the present disclosure.

Referring to FIGS. 1-3, FIG. 1 is a flowchart of a threshold voltage detecting method according to an embodiment of the present disclosure. FIG. 2 is a schematic circuit diagram of a display device driving system according to an embodiment of the present disclosure. FIG. 3 is a timing diagram of a display device driving system according to an embodiment of the present disclosure. It should be noted that the threshold voltage detecting method shown in FIG. 1 can be applied not only to a display device driving system 100 shown in FIG. 2, but also to other display device driving systems. In conjunction with FIGS. 1-3, the threshold voltage detecting method provided in an embodiment of the present disclosure includes following steps:

In step S1, the display device driving system 100 is provided. The display device driving system 100 comprises a pixel driving circuit 101 and a detecting circuit 102 electrically connected to the pixel driving circuit 101.

The pixel driving circuit 101 comprises a driving transistor TD, a first transistor T1, a second transistor T2, a storage capacitor $C_{st}$, and a light-emitting device D. A gate of the driving transistor TD, one of a source and a drain of the first transistor T1, and a first end of the storage capacitor $C_{st}$ are electrically connected to a first node a. One of a source and a drain of the driving transistor TD is electrically connected to a first voltage source $V_{dd}$. Another one of the source and the drain of the driving transistor TD, one of a source and a drain of the second transistor T2, a second end of the storage capacitor $C_{st}$, and an anode of the light-emitting device D are electrically connected to a second node b. Another one of the source and the drain of the first transistor T1 is connected to a data signal DA. A gate of the first transistor T1 is connected to a control signal G1. Another one of the source and the drain of the second transistor T2 is electrically connected to the detecting circuit 102. A gate of the second transistor T2 is connected to a detecting signal G2. A cathode of the light-emitting device D is electrically connected to a second voltage source $V_{ss}$.

Specifically, the driving transistor TD is used to control a current flowing through the light-emitting device D. The first transistor T1 is a switching transistor. The second transistor T2 is a detecting transistor. In some embodiments, the driving transistor TD, the first transistor T1, and the second transistor T2 may be one or more of a low temperature polysilicon thin film transistor, an oxide semiconductor thin film transistor, or an amorphous silicon thin film transistor. Further, transistors in the pixel driving circuit 101 provided in the embodiment of the present disclosure may be provided as a same type of transistors, so as to preventing influence of differences between different types of transistors on the pixel driving circuit 101.

The detecting circuit 102 comprises a first switching element H1 and a second switching element H2. A first terminal of the first switching element H1 is electrically connected to another one of the source and the drain of the second transistor T2. A second terminal of the first switching element H1 is electrically connected to a detecting terminal c. A first terminal of the second switching element H2 is electrically connected to another one of the source and drain of the second transistor T2. A second terminal of the second switching element H2 is connected to an initial signal SA.

In step S2, the control signal G1 supplies a turned-on potential, the detecting signal G2 supplies a turned-on potential, the first transistor T1 is turned on, the second transistor T2 is turned on, the data signal DA supplies a data potential $V_{data}$ to the first node a, and the detecting circuit 102 supplies an initialization potential $V_0$ to the second node b.

Since the control signal G1 supplies the turned-on potential, the first transistor T1 is turned on under action of the control signal, and at this time, the data signal DA supplies the data potential $V_{data}$ to the first node a, so that a potential of the gate of the driving transistor TD is the data potential $V_{data}$ Since the detecting signal G2 supplies the turned-on potential, the second transistor T2 is turned on under action of the detecting signal G2, and at this time, the detecting circuit 102 supplies the initialization potential $V_0$ to the second node b so that a potential of another one of the source and the drain of the driving transistor TD is the initialization potential $V_0$.

Specifically, the detecting circuit 102 supplies the initialization potential $V_0$ to the second node b under action of a first switching control signal S1 and a second switching control signal S2. The first switching control signal S1 supplies the turned-off potential and the second switching control signal S2 supplies the turned-on potential. The first switching element H1 is turned off under action of the first switching control signal S1. The second switching element H2 is turned on under action of the second switching control signal S2. The initial signal SA supplies the initialization potential $V_0$ which is output to the second node b via the second switching element H2 and the second transistor T2.

A difference between the data potential $V_{data}$ and the initialization potential $V_0$ is greater than the threshold voltage of the driving transistor TD. That is, a difference between the potential of the gate of the driving transistor TD and the potential of another one of the source and the drain of the driving transistor TD is greater than the threshold voltage of the driving transistor TD, and at this time, the driving transistor TD is turned on.

In step S3, the control signal G1 supplies the turned-on potential, the detecting signal G2 supplies the turned-off potential, the first transistor T1 is turned on and the second transistor T2 is turned off, the data signal DA continues to supply the data potential $V_{data}$ to the first node a, and a potential of the second node b is raised by a driving current until a difference between a potential of the first node a and the potential of the second node b is equal to the threshold voltage of the driving transistor TD.

Since the control signal G1 supplies the turned-on potential, the first transistor T1 continues to be turned on under action of the control signal, at this time, the data signal DA continues to supply the data potential $V_{data}$ to the first node a, so that the potential of the gate of the driving transistor TD remains the data potential $V_{data}$ Since the detecting signal G2 supplies the turned-off potential, the second transistor T2 is turned off under action of the detecting signal G2. Since the driving transistor TD is turned on, the potential of the second node b is raised under action of the driving current, and when the potential of the second node b is raised so that the difference between the potential of the first node a and the potential of the second node b is equal to the threshold voltage of the driving transistor TD, the driving transistor TD is turned off, and the potential of the second node b is not changed anymore.

In the embodiment of the present disclosure, in step S2, since the second transistor T2 is turned off, the driving current only needs to charge the storage capacitor $C_{st}$, but does not need to charge the parasitic capacitor on the detecting circuit 102. Therefore, a threshold voltage detecting time of the driving transistor TD can be shortened, threshold voltage detecting efficiency of the driving transistor TD can be improved, and user experience can be improved.

A time spent for the potential of the second node b to be raised by the driving current so that the difference between the potential of the first node a and the potential of the second node b is equal to the threshold voltage of the driving transistor TD is less than 30 milliseconds.

It will be understood that, in this embodiment of the present disclosure, a path between the driving transistor TD and the detecting circuit 102 is shut down in step S2, so that the driving current flowing through the driving transistor TD only needs to charge the storage capacitor $C_{st}$, which prevents charging the parasitic capacitor on the detecting circuit 102. A capacitance value of the parasitic capacitor on the detecting circuit 102 is typically hundreds of times a capacitance value of the storage capacitor $C_{st}$, so that detecting time will also be reduced by hundreds of times. After an extremely short time elapses, the storage capacitor $C_{st}$ can complete storage of the threshold voltage of the driving transistor TD. In this detecting mode, detection of the threshold voltage of the driving transistor TD can be completed in tens of microseconds, so that the detection of the threshold voltage of the driving transistor TD can be performed while displaying, thereby greatly improving detecting efficiency of threshold voltage difference of the driving transistor TD and the user experience.

The driving current $I=(\mu*w*Cox)/2L*(V_g-V_s-V_{th})\hat{}2$, μ is mobility of the driving transistor TD, W/L is a width-to-length ratio of a conductive channel of the driving transistor TD, Cox is a gate oxide layer capacitance per unit area of the driving transistor TD, $V_g$ is the potential of the first node a, $V_s$ is the potential of the second node b, and $V_{th}$ is the threshold voltage of the driving transistor TD. Specifically, the potential of the first node a remains unchanged, and the potential of the second node b increases as the driving current charges the storage capacitor $C_{st}$.

The potential of the second node b is $V_s=V_0+I/C_1$, $V_0$ is the initialization potential, and $C_1$ is the capacitance value of the storage capacitor $C_{st}$. As the potential of the second node b rises, the driving current decreases until the potential of the second node b becomes stable when the driving current is zero.

In step S4, the control signal G1 supplies the turned-off potential, the detecting signal G2 supplies the turned-on potential, the first transistor T1 is turned off, the second transistor T2 is turned on, the storage capacitor $C_{st}$ is voltage coupled to the parasitic capacitor on the detecting circuit 102, the detecting circuit 102 detects the potential of the second node b and calculates the threshold voltage of the driving transistor TD based on the potential of the second node b.

Since the control signal G1 supplies the turned-off potential, the first transistor T1 is turned off under action of the control signal G1. Since the detecting signal G2 supplies the turned-on potential, the second transistor T2 is turned on under action of the detecting signal G2. At this time, the storage capacitor $C_{st}$ is voltage coupled with the parasitic capacitor on the detecting circuit 102, the detecting circuit 102 detects the potential of the second node b and calculates the threshold voltage of the driving transistor TD based on the potential of the second node b.

It should be noted that threshold voltages of the different driving transistors TD are different. Therefore, the potential of the second node b rises differently in step S3. When the voltage coupling is performed, the coupled voltage will include information about the threshold voltage of the driving transistor TD. Since the parasitic capacitor on the detecting circuit 102 is several hundred times of the storage capacitor $C_{st}$, a potential difference of the first nodes a of different sub-pixels after coupling is also reduced by several hundred times, and a relatively small voltage difference is detected, and the difference needs to be amplified. That is, the potential of the first node a may be amplified.

Specifically, the step of the detecting circuit 102 detecting the potential of the second node b and calculating the threshold voltage of the driving transistor TD based on the potential of the second node b comprises: obtaining the potential of the second node b after the voltage coupling; obtaining the potential of the second node b before the voltage coupling based on the potential of the second node b after the voltage coupling and a preset voltage coupling formula; and obtaining the threshold voltage of the driving transistor TD according to the potential of the second node b before the voltage coupling, the data potential $V_{data}$, and a threshold voltage calculation formula.

The preset voltage coupling formula is $V_{s1}=(V_{s2}-V_0)*(C_1+C_2)/C_2+V_0$, $V_{s1}$ is the potential of the second node b before the voltage coupling, $V_{s2}$ is the potential of the second node b after the voltage coupling, $V_0$ is the initialization potential, $C_1$ is the capacitance value of the storage capacitor $C_{st}$, and $C_2$ is the capacitance value of the parasitic capacitor.

The threshold voltage calculation formula is $V_{th}=V_g-V_{s1}$, $V_{th}$ is the threshold voltage of the driving transistor TD, $V_g$ is the potential of the first node a, and $V_{s1}$ is the potential of the second node b before the voltage coupling.

The above is merely embodiments of the present disclosure, and is not intended to limit patent scope of the present disclosure. Any equivalent structure or equivalent flow transformation made using the specification of the present disclosure and the contents of the accompanying drawings, or directly or indirectly applied to other related technical fields, is likewise included within the s the patent protection scope of the present disclosure.

What is claimed is:

1. A threshold voltage detecting method, wherein the threshold voltage detecting method comprises:

step S1, providing a display device driving system, wherein the display device driving system comprises a pixel driving circuit and a detecting circuit electrically connected to the pixel driving circuit;

the pixel driving circuit comprises a driving transistor, a first transistor, a second transistor, a storage capacitor, and a light-emitting device;

a gate of the driving transistor, one of a source and a drain of the first transistor, and a first end of the storage capacitor are electrically connected to a first node;

one of a source and a drain of the driving transistor is electrically connected to a first voltage source;

another one of the source and the drain of the driving transistor, one of a source and a drain of the second transistor, a second end of the storage capacitor, and an anode of the light-emitting device are electrically connected to a second node;

another one of the source and the drain of the first transistor is connected to a data signal, and a gate of the first transistor is connected to a control signal;

another one of the source and the drain of the second transistor is electrically connected to the detecting circuit, and a gate of the second transistor is connected to a detecting signal; and a cathode of the light-emitting device is electrically connected to a second voltage source;

step S2, supplying a turned-on potential by the control signal and supplying a turned-on potential by the detecting signal, wherein the first transistor is turned on, the second transistor is turned on, the data signal supplies a data potential to the first node, and the detecting circuit supplies an initialization potential to the second node;

step S3, supplying the turned-on potential through the control signal, supplying a turned-off potential through the detecting signal, wherein the first transistor is turned on, the second transistor is turned off, the data signal continues to supply the data potential to the first node; a potential of the second node rises under action of a driving current until a difference between a potential of the first node and the potential of the second node is equal to a threshold voltage of the driving transistor; and step S4, supplying a turned-off potential through the control signal, supplying the turned-on potential though the detecting signal, wherein the first transistor is turned off, the second transistor is turned on, the storage capacitor is voltage coupled to a parasitic capacitor on the detecting circuit, the detecting circuit detects the potential of the second node and calculates the threshold voltage of the driving transistor based on the potential of the second node;

wherein in step S2, a difference between the data potential and the initialization potential is greater than the threshold voltage of the driving transistor;

in step S3, the driving current $I=(\mu*w*Cox)/2L*(V_g-V_s-V_{th})^2$, wherein μ is mobility of the driving transistor, W/L is a width-to-length ratio of a conductive channel of the driving transistor, Cox is a gate oxide layer capacitance per unit area of the driving transistor, $V_g$ is the potential of the first node, $V_s$ is the potential of the second node, and $V_{th}$ is the threshold voltage of the driving transistor.

2. The threshold voltage detecting method according to claim 1, wherein in step S3, the potential of the second node is $V_s=V_0+I/C_1$, wherein $V_0$ is the initialization potential, and $C_1$ is a capacitance value of the storage capacitor.

3. The threshold voltage detecting method according to claim 2, wherein in step S3, the potential of the first node remains unchanged, and the potential of the second node increases as the driving current charges the storage capacitor.

4. The threshold voltage detecting method according to claim 2, wherein the driving current decreases while the potential of the second node increases until the potential of the second node becomes stable when the driving current is 0.

5. The threshold voltage detecting method according to claim 1, wherein step S4 of the detecting circuit detecting the potential of the second node and calculating the threshold voltage of the driving transistor based on the potential of the second node comprises:

obtaining the potential of the second node after voltage coupling;

obtaining the potential of the second node before the voltage coupling based on the potential of the second node after the voltage coupling and a preset voltage coupling formula; and obtaining the threshold voltage of the driving transistor according to the potential of the second node before the voltage coupling, the data potential, and a threshold voltage calculation formula.

6. The threshold voltage detecting method according to claim 5, wherein the preset voltage coupling formula is $V_{s1}=(V_{s2}-V_0)*(C_1+C_2)/C_2+V_0$, wherein $V_{s1}$ is the potential of the second node before the voltage coupling, $V_{s2}$ is the potential of the second node after the voltage coupling, $V_0$ is the initialization potential, $C_1$ is a capacitance value of the storage capacitor, and $C_2$ is a capacitance value of the parasitic capacitor.

7. The threshold voltage detecting method according to claim 5, wherein the threshold voltage calculation formula is $V_{th}=V_g-V_{s1}$, wherein $V_{th}$ is the threshold voltage of the driving transistor, $V_g$ is the potential of the first node, and $V_{s1}$ is the potential of the second node before the voltage coupling.

8. The threshold voltage detecting method according to claim 1, wherein a time spent for the potential of the second node to rise under action of the driving current until the difference between the potential of the first node and the potential of the second node is equal to the threshold voltage of the driving transistor is less than 30 milliseconds.

9. A threshold voltage detecting method, wherein the threshold voltage detecting method comprises:

step S1, providing a display device driving system, wherein the display device driving system comprises a pixel driving circuit and a detecting circuit electrically connected to the pixel driving circuit;

the pixel driving circuit comprises a driving transistor, a first transistor, a second transistor, a storage capacitor, and a light-emitting device;

a gate of the driving transistor, one of a source and a drain of the first transistor, and a first end of the storage capacitor are electrically connected to a first node;

one of a source and a drain of the driving transistor is electrically connected to a first voltage source;

another one of the source and the drain of the driving transistor, one of a source and a drain of the second transistor, a second end of the storage capacitor, and an anode of the light-emitting device are electrically connected to a second node;

another one of the source and the drain of the first transistor is connected to a data signal, and a gate of the first transistor is connected to a control signal;

another one of the source and the drain of the second transistor is electrically connected to the detecting circuit, and a gate of the second transistor is connected to a detecting signal; and a cathode of the light-emitting device is electrically connected to a second voltage source;

step S2, supplying a turned-on potential by the control signal, supplying a turned-on potential by the detecting signal, wherein the first transistor is turned on, the second transistor is turned on, the data signal supplies a data potential to the first node, and the detecting circuit supplies an initialization potential to the second node;

step S3, supplying the turned-on potential by the control signal, supplying a turned-off potential by the detecting signal, wherein the first transistor is turned on, the second transistor is turned off, the data signal continues to supply the data potential to the first node, a potential of the second node rises under action of a driving current until a difference between a potential of the first node and the potential of the second node is equal to a threshold voltage of the driving transistor; and step S4, supplying a turned-off potential by the control signal, supplying the turned-on potential by the detecting signal, wherein the first transistor is turned off, the second transistor is turned on, the storage capacitor is voltage coupled to a parasitic capacitor on the detecting circuit, the detecting circuit detects the potential of the second node and calculates the threshold voltage of the driving transistor based on the potential of the second node.

10. The threshold voltage detecting method according to claim 9, wherein in step S2, a difference between the data potential and the initialization potential is greater than the threshold voltage of the driving transistor.

11. The threshold voltage detecting method according to claim 9, wherein in step S3, the driving current $I=(\mu*w*Cox)/2L*(V_g-V_s-V_{th})\hat{}2$, wherein μ is mobility of the driving transistor, W/L is a width-to-length ratio of a conductive channel of the driving transistor, Cox is a gate oxide layer capacitance per unit area of the driving transistor, $V_g$ is the potential of the first node, $V_s$ is the potential of the second node, and $V_{th}$ is the threshold voltage of the driving transistor.

12. The threshold voltage detecting method according to claim 11, wherein in step S3, the potential of the second node is $V_s=V_0+I/C_1$, wherein $V_0$ is the initialization potential, and $C_1$ is a capacitance value of the storage capacitor.

13. The threshold voltage detecting method according to claim 12, wherein in step S3, the potential of the first node remains unchanged, and the potential of the second node increases as the driving current charges the storage capacitor.

14. The threshold voltage detecting method according to claim 12, wherein the driving current decreases while the potential of the second node increases until the potential of the second node becomes stable when the driving current is 0.

15. The threshold voltage detecting method according to claim 9, wherein step S4 of the detecting circuit detecting the potential of the second node and calculating the threshold voltage of the driving transistor based on the potential of the second node comprises:

obtaining the potential of the second node after voltage coupling;

obtaining the potential of the second node before the voltage coupling based on the potential of the second node after the voltage coupling and a preset voltage coupling formula; and obtaining the threshold voltage of the driving transistor according to the potential of the second node before the voltage coupling, the data potential, and a threshold voltage calculation formula.

16. The threshold voltage detecting method according to claim 15, wherein the preset voltage coupling formula is $V_{s1}=(V_{s2}-V_0)*(C_1+C_2)/C_2+V_0$, wherein $V_{s1}$ is the potential of the second node before the voltage coupling, $V_{s2}$ is the potential of the second node after the voltage coupling, $V_0$ is the initialization potential, $C_1$ is a capacitance value of the storage capacitor, and C2 is a capacitance value of the parasitic capacitor.

17. The threshold voltage detecting method according to claim 15, wherein the threshold voltage calculation formula is $V_{th}=V_g-V_{s1}$, wherein $V_{th}$ is the threshold voltage of the driving transistor, $V_g$ is the potential of the first node, and $V_{s1}$ is the potential of the second node before the voltage coupling.

18. The threshold voltage detecting method according to claim 9, wherein a time spent for the potential of the second node to rise under action of the driving current until the difference between the potential of the first node and the potential of the second node is equal to the threshold voltage of the driving transistor is less than 30 milliseconds.

* * * * *